US008644114B2

(12) United States Patent
Fluhrer et al.

(10) Patent No.: US 8,644,114 B2
(45) Date of Patent: Feb. 4, 2014

(54) SIGNAL TRANSMITTER DEVICE COMPRISING AN ELECTRICAL ACOUSTIC SIGNAL TRANSMITTER

(75) Inventors: Henry Fluhrer, Bretten (DE); Frank Stuhr, Kürnbach (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 470 days.

(21) Appl. No.: 13/008,363

(22) Filed: Jan. 18, 2011

(65) Prior Publication Data

US 2011/0176392 A1 Jul. 21, 2011

(30) Foreign Application Priority Data

Jan. 19, 2010 (DE) ..... 10 2010 005 654

(51) Int. Cl.
*B06B 1/06* (2006.01)

(52) U.S. Cl.
USPC ..... 367/140

(58) Field of Classification Search
USPC ..... 367/141–190
See application file for complete search history.

(56) References Cited

U.S. PATENT DOCUMENTS

| | | | | |
|---|---|---|---|---|
| 4,292,274 | A | 9/1981 | Faitani et al. | |
| 4,841,493 | A | 6/1989 | Meisner et al. | |
| 5,784,340 | A * | 7/1998 | Kanai | 367/140 |
| 5,889,873 | A | 3/1999 | Sasaki | |
| 8,120,229 | B2 * | 2/2012 | Huang | 310/309 |
| 2009/0189488 | A1 | 7/2009 | Ray et al. | |

FOREIGN PATENT DOCUMENTS

| | | | |
|---|---|---|---|
| DE | 32 30 060 | A1 | 3/1983 |
| EP | 0755167 | A2 | 1/1997 |
| EP | 0796034 | A2 | 9/1997 |
| JP | 2008079230 | A | 4/2008 |

OTHER PUBLICATIONS

German Office Action from German Application No. 10 2010 005 654.5 dated Jun. 18, 2010.

European Patent Office, Search Report and Search Opinion for Application No. 10196143.1, dated Sep. 14, 2012, 6 pages, The Netherlands.

* cited by examiner

*Primary Examiner* — Luke Ratcliffe
(74) *Attorney, Agent, or Firm* — Alston & Bird LLP

(57) ABSTRACT

A signal transmitter device comprises an electrical acoustic signal transmitter signal, which has a piezoceramic disk on a metal membrane, on a printed circuit board. The printed circuit board has an opening in the region of the piezoceramic disk or the metal membrane, wherein the metal membrane extends over the opening for the purpose of bearing on the printed circuit board in an edge region of the opening. The piezoceramic disk arranged on the metal membrane is arranged towards the opening and substantially in the region of the opening, wherein a contact projection as part of the printed circuit board for electrical contact-connection to the signal transmitter is provided at the edge region of the opening. Separate parts can thus be obviated.

19 Claims, 3 Drawing Sheets

SIGNAL TRANSMITTER DEVICE COMPRISING AN ELECTRICAL ACOUSTIC SIGNAL TRANSMITTER

CROSS REFERENCE TO RELATED APPLICATIONS

This application claims priority to German Application Number 10 2010 005 654, filed on Jan. 19, 2010, the contents of which are incorporated by reference for all that it teaches.

BACKGROUND OF THE INVENTION

The invention relates to a signal transmitter device comprising an electrical acoustic signal transmitter having a piezoceramic disk on a metal membrane, said signal transmitter also being known as a piezo-buzzer, for example.

A similar signal transmitter device is known from U.S. Pat. No. 4,841,493, for example. In that case, the signal transmitter lies over an opening in a printed circuit board or in a carrier, with the metal membrane facing towards the carrier, while the piezoceramic disk faces away therefrom. Similar signal transmitters are also known and available as surface mounted device ("SMD") components, wherein corresponding electrical connections are then provided on the carrier or a resonator housing.

SUMMARY

An object of the invention is to provide a signal transmitter device as disclosed above which can be used to solve problems in the prior art and, in particular, to provide a practical and functionally entirely satisfactory construction that is suitable for simple and reliable mounting.

This object is achieved in one embodiment by means of a signal transmitter device as claimed herein. Advantageous and preferred configurations of the invention are the subject matter of the further claims and are explained in greater detail below. The wording of the claims is incorporated by express reference in the content of the description.

The printed circuit board or a corresponding carrier for the signal transmitter has an opening in the region of the piezoceramic disk or the metal membrane. Said opening serves for acoustic amplification and/or to enable the signal transmitter to oscillate better or even oscillate in the first place. In this embodiment, the metal membrane substantially extends over the opening in order to bear on the printed circuit board in its edge region. Thus, the metal membrane and in particular the signal transmitter can also be fixed to the printed circuit board.

According to one embodiment of the invention, the piezoceramic disk is arranged on the metal membrane, or the signal transmitter is arranged on the printed circuit board, in such a way that the piezoceramic disk faces toward the opening and advantageously even substantially projects into the opening, and is at least arranged in the region thereof. In the edge region of the opening, a projecting contact projection is provided for the electrical contact-connection to the signal transmitter, wherein the contact projection proceeds from the edge region or from the inner edge. Advantageously, the contact projection projects from the printed circuit board or the latter forms it.

In this way, this achieves a good mechanical or acoustic functionality of the signal transmitter in interaction with the opening in the printed circuit board or the carrier. Further, however, the arrangement of the signal transmitter in such a way that the piezoceramic disk faces toward the opening or the printed circuit board makes it possible to facilitate and improve the electrical contact-connection thereto, that is to say both to the metal membrane and to the piezoceramic disk. This will be explained in greater detail below.

Advantageously, the piezoceramic can also be embodied as a thin layer, for example having a thickness of approximately 30 μm to 150 μm, particularly advantageously approximately 50 μm, wherein it can be printed or vapor-deposited onto the metal membrane. However, it will still be regarded as a disk hereinafter.

In another embodiment of the invention, the metal membrane can substantially cover, particularly advantageously, the opening in the printed circuit board. It can rest or bear on a ring electrode that lies at the opening or runs around the edge region thereof. In this case, the ring electrode can run around substantially or even completely. It can be embodied as a conventional metal layer or metallization and make electrical contact with the metal membrane, for example by soldering, as an electrical connection to the signal transmitter.

In another embodiment of the invention, the ring electrode can have a plated-through hole through the printed circuit board in at least one location. Thus, the ring electrode can be connected to an electrical connection or a conductor track on the other side of the printed circuit board, either as external connection possibility or as interconnection with other components or circuit parts on the printed circuit board. Such a plated-through hole through a printed circuit board or a corresponding carrier does not pose a problem technically and is sufficiently known to the person skilled in the art, for example, as a through hole with an electrically conductive coating on the inner wall of the through hole.

The contact projection for the electrical contact-connection to the signal transmitter is advantageously formed from the printed circuit board, or projects as an integral part of it from the inner edge of the printed circuit board into the opening. It can be advantageously embodied substantially in the form of a bar or a nose-piece, that is to say, in an elongate fashion. In particular it has an approximately uniform width. Its length can be as desired, in principle. Thus, for example, it can also virtually bridge the majority of the opening. Advantageously, the length of the contact projection is approximately 10% to 50% of the diameter of the opening. In this embodiment, it can run substantially straight and in a direction toward a midpoint of the opening. In its end region, the contact projection can have a contact zone or a contact point by which it bears against the piezoceramic disk. The electrical contact-connection thereto is therefore effected via a bearing contact. The latter can possibly be improved with an electrically conductive adhesive or a soldered joint, but this is not necessary in all embodiments.

By means of the contact projection, particularly if it is embodied according to one of the abovementioned possibilities, it is therefore possible to reach the piezoceramic disk from the edge of the opening and thus from the printed circuit board directly, for the electrical contact-connection of said disk. Separate components such as contact bridges, contact arms to be fitted separately or the like, are not required, which has a very advantageous effect on the simplicity and reliability of mounting.

For a reliable electric contact-connection even in the case of mechanical movement of the signal transmitter or mechanical tolerances, it may be provided, in particular by means of the abovementioned contact zone, that the contact projection and therefore also the contact zone bears against the piezoceramic disk with prestress or a certain force. By virtue of the elongate embodiment of the contact projection, the latter has certain elastic spring properties. Thus, the electrical contact is always ensured, even in the case of movement or oscillations of the signal transmitter.

In a further embodiment of the invention, the electrical contact-connection to the piezoceramic disk can have a plated-through hole through the printed circuit board, which is led to a contact zone or a conductor track or an electrical connection on the other side of the printed circuit board. Consequently, in a manner similar to that described above for the contact-connection to the metal membrane, a plated-through hole can also be provided for the electrical connection to the piezoceramic disk. Particularly advantageously, the plated-through hole is provided very near or in the region of the electrical contact-connection to the piezoceramic disk, for example, actually in the contact projection itself or below the contact zone. Particularly advantageously, the plated-through hole is provided exactly at the location at which a contact zone or the like for bearing against the piezoceramic disk is also provided. This has the advantage that the remaining top side of the contact projection is then separated from a contact-connection, or a corresponding conductor track, and therefore does not entail any problems with regard to the fact that further toward the outside in the edge region of the opening the metal membrane of the signal transmitter is present or covers the contact projection. Thus, for the metal membrane, too, it is possible to provide an abovementioned ring electrode running completely around the opening. The holding projection extends within said ring electrode or it can also be provided on the holding projection, but at a distance from a plated-through hole or a contact zone to the piezoceramic disk, the electrical connection of which, specifically, is then effected on the other side of the printed circuit board. Consequently, overall both connections can also be provided on the other side of the printed circuit board by means of corresponding plated-through holes. They can then run alongside one another there without any problems.

In an alternative embodiment of the invention, an electrical contact-connection on the contact projection to the piezoceramic disk can be formed without through-plating onto the other side. The contact-connection then runs on this side of the printed circuit board, along the contact projection outward with a conductor track from a contact zone on the contact projection for the piezoceramic disk to a remote electrical connection. For this purpose, it is possible to provide an insulating cover over said conductor track, at least in the region in which the metal membrane projecting beyond the piezoceramic disk also runs over said conductor track or projects beyond the latter. The insulating cover should cover the conductor track apart from the contact zone at least over the length of the contact projection and, for safety reasons, also project or protrude a little beyond the metal membrane. An insulating cover can be, for example, a soldering resist that is applied to the printed circuit board anyway, or some other coating. Alternatively, it can be a piece of adhesive film or the like.

In order to increase the flexibility of the contact projection even further, since, as a result of soldering to the piezoceramic disk for the electrical contact-connection, said contact projection can be part of the oscillating system and exerts a certain damping, incisions into the printed circuit board can be provided on both sides of the contact projection. Thus, the contact projection is lengthened as it were, even though it does not project further into the opening. Said incisions can have between 50% and 300% of the free length of the contact projection within the opening, that is to say, form a lengthening that is significant under certain circumstances. These incisions can interrupt or disturb somewhat the formation of the abovementioned ring electrodes for the electrical contact-connection to the metal membrane, but in practice this is manifested only in the minimally shortened contact length or contact area thereof and is therefore not disturbing.

The opening in the printed circuit board and the piezoceramic disk can have a substantially corresponding or identical form, and both can be particularly advantageously circular. In this case, the piezoceramic disk is preferably arranged concentrically with respect to the opening in the printed circuit board, even though usually it does not project into the latter, but rather runs somewhat above the plane of the printed circuit board.

In a further embodiment of the invention, a drive circuit, preferably comprising a microcontroller, designed for driving the signal transmitter, can be provided on the printed circuit board or the carrier at a small distance from the opening. It can be arranged on the same side as the signal transmitter, for example, and a distance can be approximately of the order of magnitude of the diameter of the metal membrane. It is thus possible to provide an overall signal transmitter device which has a compact construction and can be produced easily. If the drive circuit is situated on the same side of the printed circuit board as the signal transmitter, then an electrical connection to the signal transmitter without the abovementioned plated-through holes is advantageously chosen, that is to say in particular with an insulating cover over a conductor track at the contact projection to the piezoceramic disk.

In yet a further embodiment of the invention, a resonator housing can be provided in a conventional manner over the signal transmitter. It can be embodied as a Helmholtz resonator and can be advantageously arranged on the same side of the printed circuit board as the signal transmitter. It can be embodied as a plastic component which is pressed into corresponding recesses in the printed circuit board and then holds it there by clamping or in some other way.

These and further features emerge not only from the claims but also from the description and the drawings, wherein the individual features can be realized in each case by themselves or as a plurality in the form of subcombinations in one or more embodiments of the invention and in other fields that can constitute advantageous and inherently protectable embodiments for which protection is claimed here. The subdivision of the application into individual sections and sub-headings does not restrict the general validity of the statements made hereunder.

BRIEF DESCRIPTION OF THE DRAWINGS

Exemplary embodiments of the invention are illustrated schematically in the drawings and are explained in greater detail below. In the drawings.

DETAILED DESCRIPTION

Figure 1B:
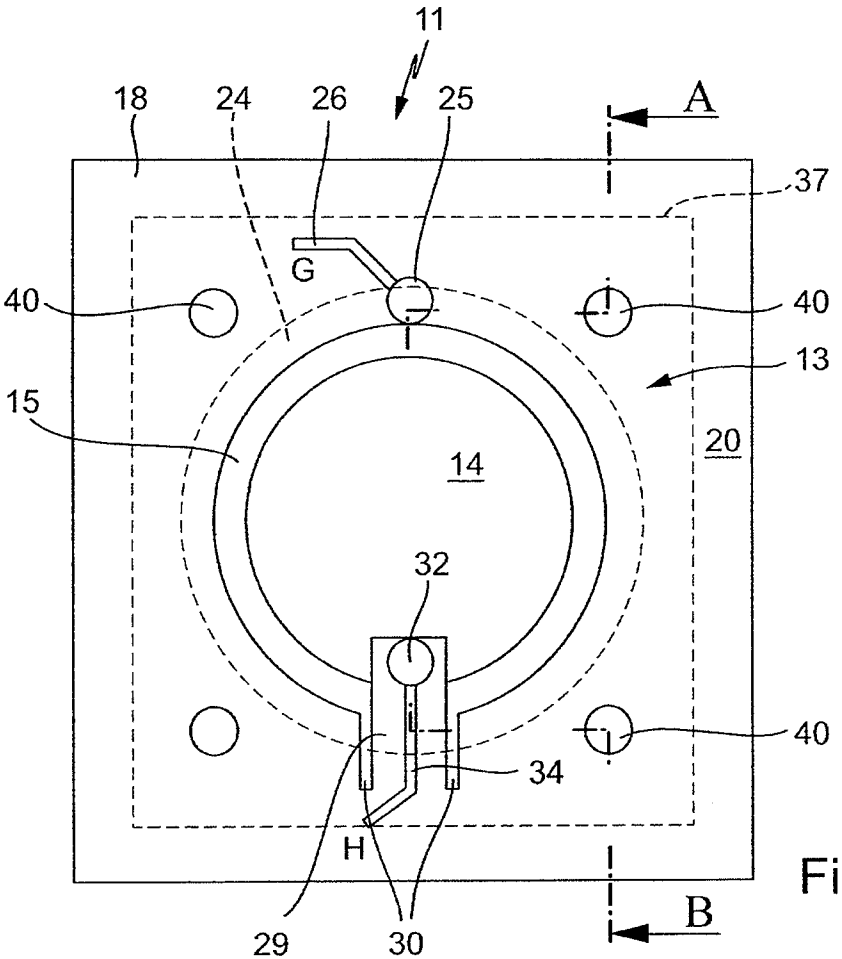
FIGS. 1A and 1B show a lateral section and a plan view of a signal transmitter device according to the invention in accordance with a first configuration of the invention with plated-through holes.
Figure 1A:
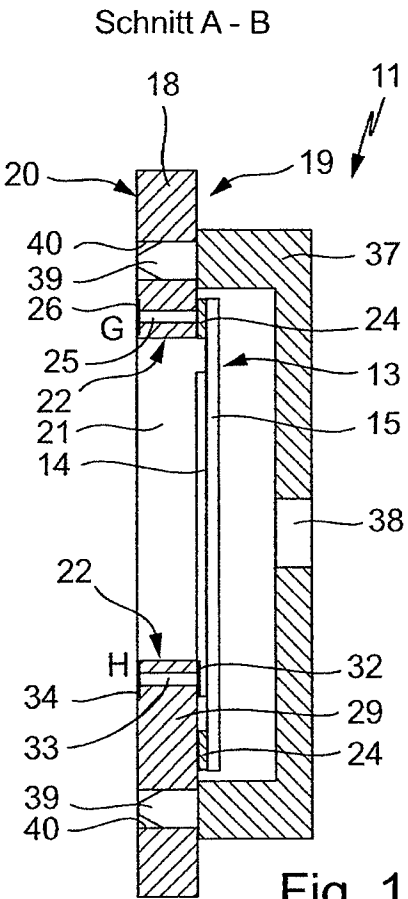

FIG. 1A illustrates a section A-B from FIG. 1B, said section showing a plan view of an excerpt from a signal transmitter device 11 in accordance with a first aspect of the invention. The signal transmitter device 11 has an electrical acoustic signal transmitter 13 having a piezoceramic disk 14 and a metal membrane 15. Such signal transmitters 13 are also known as piezo-buzzers and are frequently used for acoustic signaling.

The signal transmitter device 11 has a printed circuit board 18 having a top side 19 and an underside 20. The printed circuit board 18 forms the carrier and carries the signal transmitter 13 on the top side 19. Furthermore, it has a large, for example, circularly embodied, opening 21 having an edge 22. Said opening can also be embodied in a polygonal or rectangular fashion.

On the top side 19, a ring electrode 24, which can be embodied as an applied conductor track, runs along the edge 22. The ring electrode 24 is provided with a plated-through hole 25 from the top side 19 to the underside 20 of the printed circuit board 18, from where a conductor track 26 proceeds as connection G, as will be explained in even greater detail below.

As shown both by the sectional illustration in FIG. 1A and by the view from the underside of FIG. 1B, the signal transmitter 13 bears with its metal membrane 15, which projects laterally beyond the piezoceramic disk 14, on the ring electrode 24. Metal membrane 15 and ring electrode 24 can be soldered to one another for the electrical contact-connection and stable fixing.

The piezoceramic disk 14 is situated concentrically and as it were precisely above the opening 21. For the electrical contact-connection of said disk, a contact projection 29 embodied as a type of narrow bar or nose-piece projects from the lower edge 22 of the opening 21. Toward the edge 22, said contact projection has incisions 30 on the left and right, which as it were lengthen said contact projection and increase its elasticity, such that it is more flexible and can bend more easily. At its end, the contact projection 29 carries a contact zone 32 on the plane of the top side 19 of the printed circuit board 18. The piezoceramic disk 14 bears against said contact zone 32, and the two parts are advantageously soldered for a good electrical contact-connection. A plated-through hole 33 through the contact projection 29 is also provided in this region, which plated-through hole, on the underside 20 of the printed circuit board 18, leads to a conductor track 34 as connection H. In this case, the conductor track 34 runs on the contact projection 29 between the incisions 30.

The ring electrode 24 is illustrated in a dashed fashion in FIG. 1B, to be precise also such that it extends over the contact projection 29. Since it is severed by the incisions 30, however, it can actually also be omitted in this region, or here it need not be soldered to the metal membrane 15.

FIG. 1A also reveals that, by virtue of the height of the ring electrode 24 and the metal membrane 15 bearing thereon, the piezoceramic disk 14 runs approximately at the level of the top side 19 of the printed circuit board 18 and does not project at all, or at least does not project particularly far, into the opening 21. What can thereby be achieved is that the piezoceramic disk 14 bears only with little prestress on the contact zone 32 on the contact projection 29. As a result and primarily as a result of the incisions 30, the connection of the piezoceramic disk 14 to the contact projection 29 damps the free mobility thereof or the oscillation thereof only to the smallest possible extent.

Situated above the signal transmitter 13 is a resonator housing 37 known per se, with at least one sound hole 38 at the top side or a side area. The resonator housing 37, discernible in accordance with the dashed depiction in FIG. 1B, can be embodied as a so-called Helmholtz resonator, resonator volume and sound opening being in a corresponding relationship to one another. By means of four holding pins 39 which are fitted in its corners and engage in holes 40 in the printed circuit board 18, said resonator is fixed and, if appropriate, even adhesively bonded as well.

In an alternate embodiment of a signal transmitter device 111 in accordance with FIGS. 2A and 2B, once again a signal transmitter 113 having a piezoceramic disk 114 and a metal membrane 115 is provided, although only illustrated in the sectional illustration. A printed circuit board 118 having a top side 119 and an underside 120 has an opening 121 having an edge 122, which is covered from the top side 119 with the signal transmitter 113. The view of the top side 119 in accordance with FIG. 2B shows a ring electrode 124 all around the opening 121, which is provided with a conductor track 126 as connection G at the bottom on the left. A plated-through hole is not present here; the conductor track 126 also runs on the top side 119 of the printed circuit board 118.

A contact projection 129 once again projects from the lower edge 122 of the opening 121, said contact projection having incisions 130 on the left and right, which are not quite as deep as in FIG. 1B. In return, the contact projection 129 projects further into the opening 121.

Figure 2A:
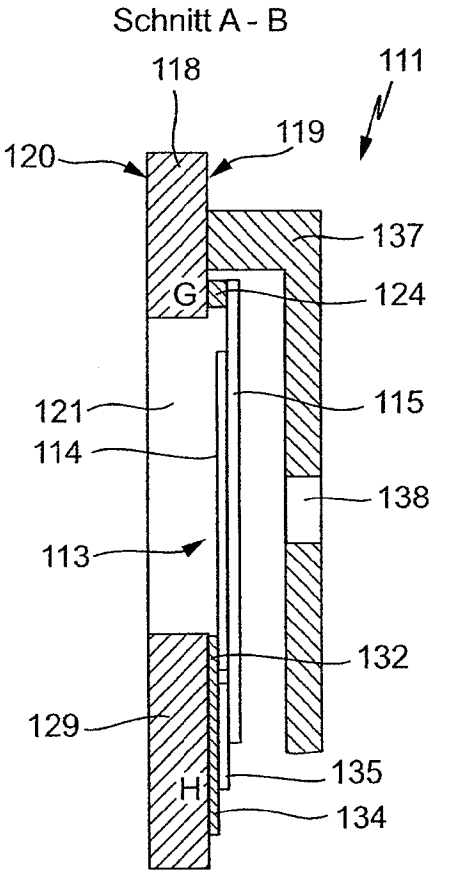
FIGS. 2A and 2B show a modification of the signal transmitter device from FIG. 1 without plated-through holes.
Figure 2B:
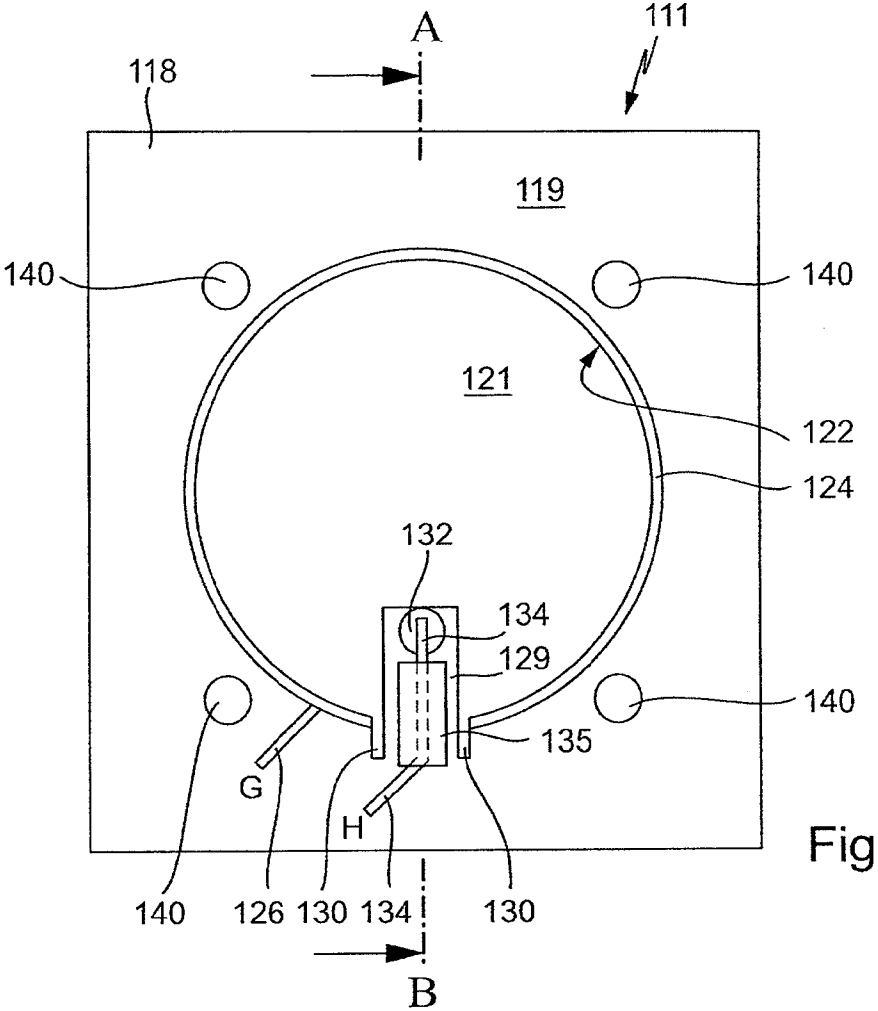

On the plane of the top side 119, the contact projection 129 has a contact zone 132, on which, in accordance with FIG. 2A, the piezoceramic disk 114 bears and is again advantageously soldered. The contact zone 132 is connected to a conductor track 134 along the contact projection 129 and on the printed circuit board 118 as connection H. The region of the transition over the edge 122 of the opening 121 is covered by an insulation 135 in a large-area manner which can be embodied, for example, as an insulating coating or else as an insulating adhesive film. It covers the conductor track 134 and electrically insulates the latter.

The sectional illustration in FIG. 2A reveals that the piezoceramic disk 114 is connected to the contact zone 132. The metal membrane 115 bears on the insulation 135 in the region of the contact projection 129, but otherwise it is electrically connected and mechanically fixed to the circumferentially extending ring electrode 124 by bearing and soldering. For this purpose, the ring electrode 124 itself or with a layer of soldering tin can be thicker in the exemplary embodiment in accordance with FIGS. 1A and 1B, to be precise approximately such that the metal membrane 115 lies on the same plane as the common level of conductor track 134 and insulation 135 thereon. Alternatively, the metal membrane 115 can also be pressed or bent onto the ring electrode 124 and then soldered without major problems. Here, too, it can be discerned that the piezoceramic disk 114 remains as it were above the top side 119 of the printed circuit board 118, or does not project into the opening 121.

In this exemplary embodiment too, a resonator housing 137 having a hole 138 is once again provided over the signal transmitter 113. The resonator housing 137 is once again fixed by means of holding pins in holes 140 in the printed circuit board 118.

Figure 3:
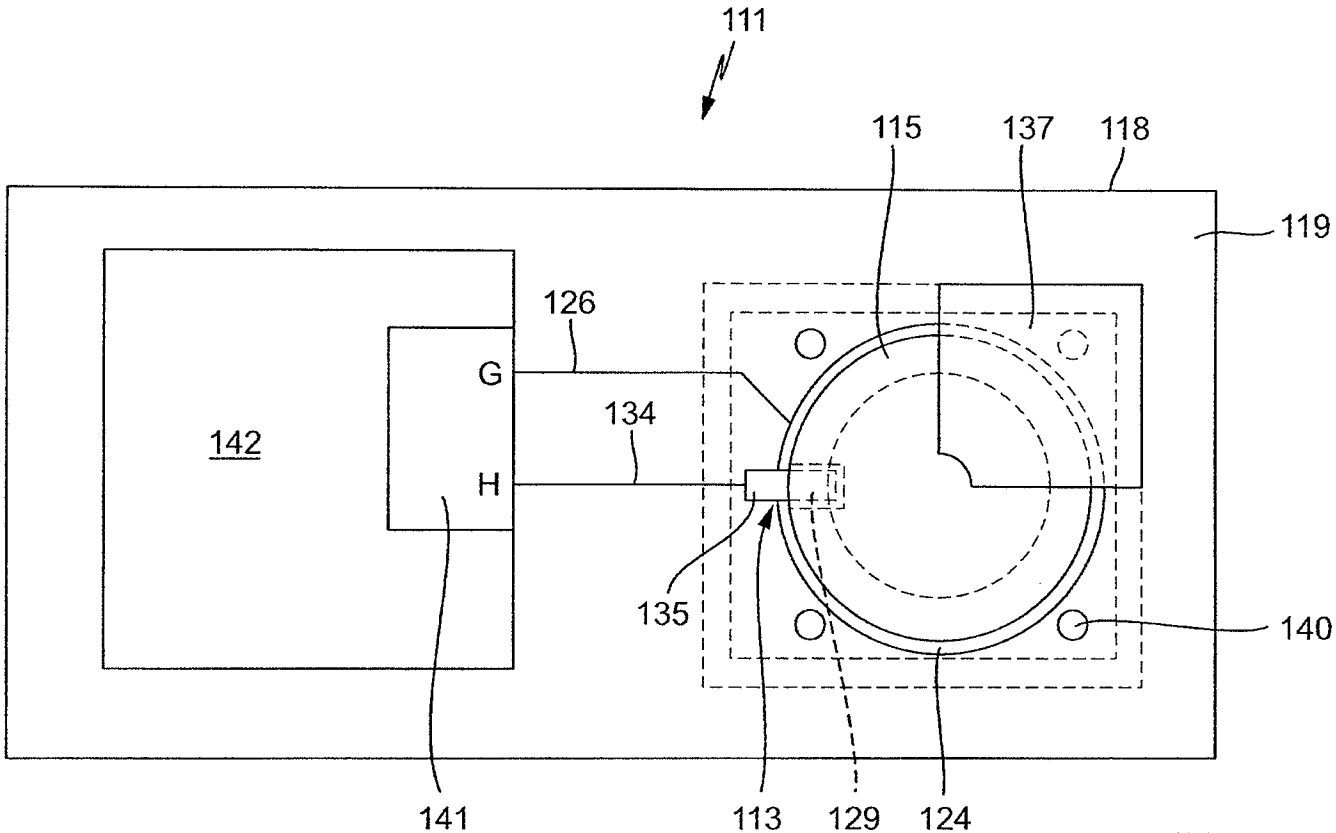
FIG. 3 shows a plan view of an overall signal transmitter device with a microcontroller on the same side as a signal transmitter.

FIG. 3 illustrates in the case of a signal transmitter device 111 similarly to FIGS. 2A and 2B with a partly sectioned resonator housing 137 in plan view how the conductor tracks 126, 134 as connection G and connection H respectively, are led to a driving electronic unit 141 in the microcontroller 142. Said microcontroller 142 is situated on the top side 119 of the printed circuit board 118. Consequently, the entire construction of the signal transmitter device 111 together with components and also with regard to the conductive parts such as ring electrode 124 and contact zone and also conductor tracks 126 and 134 are provided on one side of the printed circuit board 118.

An advantage of the signal transmitter device 11 and 111 in accordance with the figures is that no further parts besides the prefabricated and prepared printed circuit board and the signal transmitter have to be provided, possibly only just the microcontroller. This holds true particularly when the insulation 135 in accordance with FIGS. 2A and 2B is produced by a coating, that is to say virtually automatically. The printed circuit board can then be populated with the signal transmitter by means of an automatic placement machine and soldering for producing the electrical connections and the mechanical fixing can be effected virtually with SMD placement. Separate contact bridges or the like can be obviated, which makes production and fitting more expedient and more reliable.

The invention claimed is:

1. A signal transmitter device comprising:

an electrical acoustic signal transmitter having a piezoceramic disk on a metal membrane, and comprising a printed circuit board, on which said signal transmitter is arranged, wherein said printed circuit board has an opening in a region near said piezoceramic disk or said metal membrane, wherein said opening has an edge region around said opening and said metal membrane substantially extends over said opening for the purpose of bearing on said printed circuit board in said edge region, wherein said piezoceramic disk on said metal membrane is arranged in a region of said opening and said piezoceramic disk is directed towards said opening, wherein a contact projection for electrical contact-connection to said signal transmitter is provided at said edge region of said opening, and wherein said contact projection projects from said printed circuit board and is formed by a projecting part of said printed circuit board.

2. The signal transmitter device according to claim 1, wherein said metal membrane substantially covers said opening in said printed circuit board and rests on a ring electrode extending around said opening, wherein said metal membrane is electrically connected to said electrode as a connection to said signal transmitter.

3. The signal transmitter device according to claim 2, wherein said metal membrane completely covers said opening in said printed circuit board and rests at said edge region on said ring electrode extending around said opening.

4. The signal transmitter device according to claim 1, wherein said contact projection is in the form of a bar or nose-piece and projects into said opening.

5. The signal transmitter device according to claim 1, wherein said contact projection projects into said opening by approximately 10% to 50% of the diameter of said opening.

6. The signal transmitter device according to claim 4, wherein said contact projection comprises an end region having a contact zone for bearing against and making an electrical contact-connection to said piezoceramic disk.

7. The signal transmitter device according to claim 1, wherein said electrical contact-connection to said piezoceramic disk is provided with a plated-through hole through said printed circuit board to a contact zone or a conductor track on an other side of said printed circuit board.

8. The signal transmitter device according to claim 7, wherein said plated-through hole is provided in a region of said electrical contact-connection to said piezoceramic disk and penetrates through said contact projection.

9. The signal transmitter device according to claim 1, wherein said electrical contact-connection on said contact projection to said piezoceramic disk is formed without through-plating onto an other side of said printed circuit board and runs on a side of said printed circuit board, wherein a conductor track from a contact zone on said contact projection to said piezoceramic disk to an electrical connection is provided with an insulating cover, at least in a region in which said metal membrane projects beyond said piezoceramic disk runs over said conductor track.

10. The signal transmitter device according to claim 9, wherein said insulating cover covers said conductor track at least over the length of said contact projection.

11. The signal transmitter device according to claim 1, wherein in a region of a transition of said contact projection to said edge region of said opening of said printed circuit board an incision is provided on both sides of said contact projection into said printed circuit board thereby lengthening said contact projection and increasing its flexibility.

12. The signal transmitter device according to claim 11, wherein each said incision has between 50% and 300% of the length of said contact projection into said opening.

13. The signal transmitter device according to claim 1, wherein said opening in said printed circuit board and said piezoceramic disk have a substantially corresponding form.

14. The signal transmitter device according to claim 13, wherein said piezoceramic disk is arranged concentrically with respect to said opening in said printed circuit board.

15. The signal transmitter device according to claim 1, wherein a drive circuit for driving said signal transmitter is arranged on said printed circuit board at a small distance from said opening.

16. The signal transmitter device according to claim 15, wherein said small distance is approximately of the order of magnitude of the diameter of said metal membrane.

17. The signal transmitter device according to claim 15, wherein said drive circuit is arranged on the same side as said metal membrane on said piezoceramic disk.

18. The signal transmitter device according to claim 1, wherein said piezoceramic disk has a thickness of approximately 30 μm to 150 μm, wherein it is printed or vapor-deposited as a layer onto said metal membrane.

19. The signal transmitter device according to claim 1, wherein a resonator housing is provided over said metal membrane and said piezoceramic disk.

* * * * *